US009555642B2

(12) United States Patent
Gonzalez

(10) Patent No.: US 9,555,642 B2
(45) Date of Patent: Jan. 31, 2017

(54) CONTAINERS WITH A VENT

(71) Applicant: Hewlett-Packard Development Company, L.P., Houston, TX (US)

(72) Inventor: Segi Gonzalez, Añasco, PR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/074,765

(22) Filed: Mar. 18, 2016

(65) Prior Publication Data

US 2016/0200117 A1 Jul. 14, 2016

Related U.S. Application Data

(63) Continuation of application No. 14/394,145, filed as application No. PCT/US2012/047188 on Jul. 18, 2012, now Pat. No. 9,302,485.

(51) Int. Cl.
*B41J 2/175* (2006.01)
*B41J 2/19* (2006.01)

(52) U.S. Cl.
CPC *B41J 2/19* (2013.01); *B41J 2/175* (2013.01); *B41J 2/17509* (2013.01); *Y10T 29/49833* (2015.01)

(58) Field of Classification Search
CPC ... B41J 2/17509; B41J 2/17503; B41J 2/1752; B41J 2/17553; B41J 2/17556; B41J 2/17596
See application file for complete search history.

(56) References Cited

U.S. PATENT DOCUMENTS

| | | | | |
|---|---|---|---|---|
| 4,445,550 | A | 5/1984 | Davis et al. | |
| 4,693,314 | A | 9/1987 | Wesson et al. | |
| 5,775,541 | A | 7/1998 | Perkins | |
| 6,017,118 | A | 1/2000 | Gasvoda et al. | |
| 6,648,460 | B2 | 11/2003 | Gonzales | |
| 8,167,312 | B2 | 5/2012 | Adamek | |
| 2003/0142180 | A1 | 7/2003 | Gonzales | |
| 2003/0202072 | A1 | 10/2003 | Childs et al. | |
| 2009/0009569 | A1 | 1/2009 | Sasaki | |
| 2009/0033726 | A1* | 2/2009 | Iijima | B41J 2/1752 347/86 |

(Continued)

FOREIGN PATENT DOCUMENTS

| | | |
|---|---|---|
| CN | 1259087 | 7/2000 |
| CN | 101357538 | 2/2009 |

(Continued)

OTHER PUBLICATIONS

State Intellectual Property Office of the People's Republic of China, "Search Report", issued in connection with Chinese Patent Application No. 201180068981.8, issued on Sep. 12, 2014, 2 pages.

(Continued)

*Primary Examiner* — Juanita D Jackson
(74) *Attorney, Agent, or Firm* — HP Inc. Patent Department

(57) ABSTRACT

An example apparatus includes a container defining an internal volume including an aperture to provide access to the internal volume; and a vent associated with the aperture, the vent in a closed position prior to coupling the apparatus to a printer, the vent entering an open position in response to an interaction with a connector of the printer.

19 Claims, 5 Drawing Sheets

(56) References Cited

U.S. PATENT DOCUMENTS

| | | | |
|---|---|---|---|
| 2009/0267976 | A1 | 10/2009 | Lee et al. |
| 2015/0091984 | A1 | 4/2015 | Gonzalez |

FOREIGN PATENT DOCUMENTS

| | | |
|---|---|---|
| CN | 101861246 | 10/2010 |
| GB | 1147130 | 4/1969 |
| JP | H08267777 | 10/1996 |

OTHER PUBLICATIONS

United States Patent and Trademark Office, "Notice of Allowance," issued in connection with U.S. Appl. No. 14/394,145, mailed on Dec. 18, 2015, 18 pages.

Patent Cooperation Treaty, "International Preliminary Report on Patentability," issued in connection with PCT Application No. PCT/US2012/047188, issued on Jan. 20, 2015, 6 pages.

Patent Cooperation Treaty, "Written Opinion," issued in connection with PCT Application No. PCT/US2012/047188, mailed on Jan. 31, 2013, 5 pages.

Patent Cooperation Treaty, "International Search Report," issued in connection with PCT Application No. PCT/US2012/047188, mailed on Jan. 31, 2013, 8 pages.

State Intellectual Property Office of the People's Republic of China, "Office Action," issued in connection with Chinese Patent Application No. 201280072848.4, issued on Jul. 2, 2015, 8 pages.

State Intellectual Property Office of the People's Republic of China, "Notification to Grant Patent Right for Invention," issued in connection with Chinese Patent Application No. 201280072848.4, issued on Dec. 23, 2015, 5 pages.

Finot et al., "Measurement of Mechanical Properties of Cantilever Shaped Materials", Sensors, May 26, 2008, retrieved on Mar. 17, 2016, [http://www.mdpi.com/journal/sensors], 45 pages.

United States Patent and Trademark Office, "Preinterview First Office Action," issued in connection with U.S. Appl. No. 14/394,145, mailed on Jul. 6, 2015, 11 pages.

* cited by examiner

CONTAINERS WITH A VENT

RELATED APPLICATIONS

This patent arises from a continuation of U.S. patent application Ser. No. 14/394,145, filed Oct. 13, 2014, now U.S. Pat. No. 9,302,485, which is a U.S. national stage of PCT Application Serial No. PCT/US2012/047188, filed Jul. 18, 2012. Priority is claimed to U.S. patent application Ser. No. 14/394,145 and PCT Application Serial No. PCT/US2012/047188. U.S. patent application Ser. No. 14/394,145 and PCT Application Serial No. PCT/US2012/047188 are hereby incorporated herein by reference in their entireties.

BACKGROUND

Large format ink tanks are ink tanks for large format printers. Large format printers are typically operated by professional users. Large format ink tanks typically contain relatively large volumes of ink, for example more than one liter. For example, these ink tanks are transported to the professional users by transport services. Existing examples of large format ink tanks are arranged to be emptied into permanent ink tanks in the large format printer. This creates a risk that ink is spilled. Other ink tanks have internal flexible bags that carry ink. The ink tank is placed in or on the printer during usage, and connected to an ink inlet. The ink is drawn from the ink tank by a pump or other ink suction device wherein the bag flexes to compensate for a changing backpressure in the bag.

BRIEF DESCRIPTION OF THE DRAWINGS

For the purpose of illustration, certain examples constructed in accordance with the teachings of this disclosure will now be described with reference to the accompanying drawings, in which.

DETAILED DESCRIPTION

In the following detailed description, reference is made to the accompanying drawings. The examples in the description and drawings should be considered illustrative and are not to be considered as limiting to the specific example or element described. Multiple examples may be derived from the following description and/or drawings through modification, combination or variation of certain elements. Furthermore, it may be understood that examples or elements that are not literally described may be derived from the description and drawings by a person of ordinary skill in the art.

Figure 1:
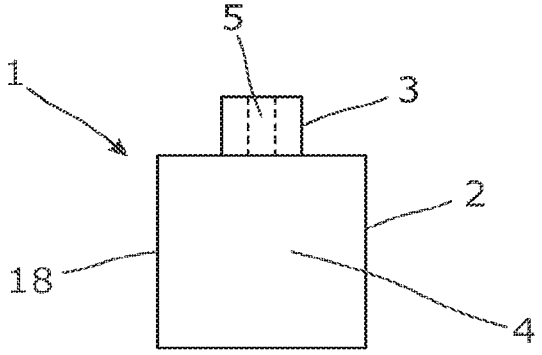
FIG. 1 illustrates a diagram of an example of an ink tank.

FIG. 1 illustrates a diagrammatic example of an ink tank 1. For example, the ink tank 1 includes a body portion 2 and a top portion 3. For example the body portion 2 includes at least one rigid surrounding wall 18 enclosing an inner volume 4 for holding ink. For example, the top portion 3 defines a lid for closing off the body portion 2. In an example, the lid is separately molded from the body portion 2, and permanently connected to the body portion 2 after filling the tank's inner volume 4 with ink. In another example, the top portion 3 and body portion 2 for a single solid ink tank. For example, the top portion 3 includes an ink outlet 5.

Figure 2:
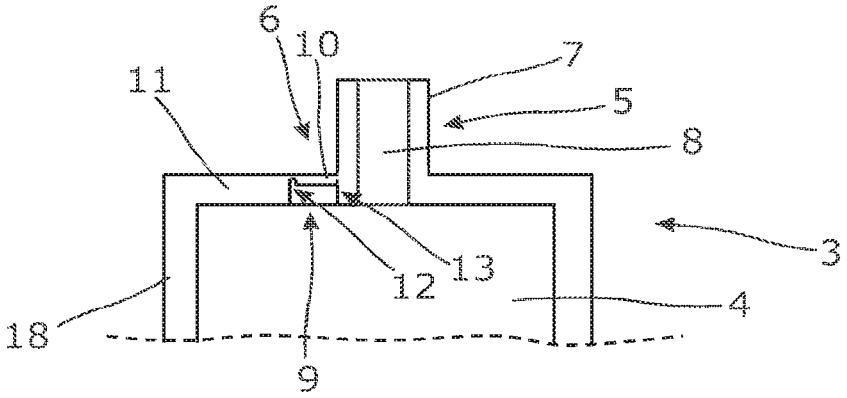
FIG. 2 illustrates a diagram of an example of an ink tank interconnect device before interconnection.
Figure 3:
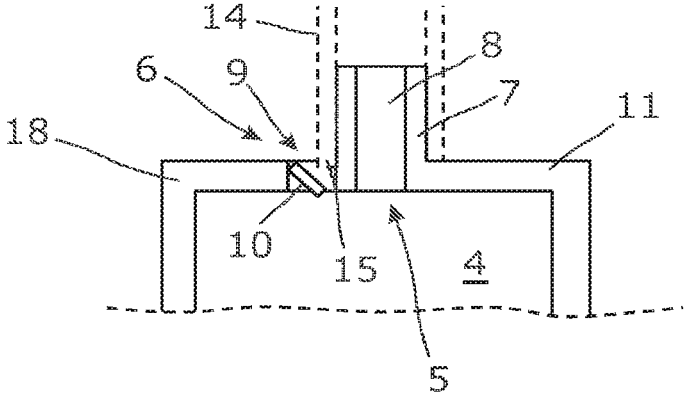
FIG. 3 illustrates a diagram of an example of an ink tank interconnect device in an interconnected state.

FIG. 2 illustrates a diagrammatic example of a top portion 3 of an ink tank 1, before being interconnected with an ink inlet (FIG. 3). The top portion 3 includes an ink tank interconnect device 6. The ink tank interconnect device 6 includes a set of features for fluidically connecting the ink tank 1 with an ink inlet. For example, the ink tank interconnect device 6 includes said ink outlet 5. For example, the ink outlet 5 includes an outward protruding ink outlet tube 7 with an inner outlet channel 8. For example the outlet tube 7 is arranged to connect to the ink inlet. The inner outlet channel 8 is connected to the inner volume 4 for transporting the ink out of the ink tank 1 to the ink inlet.

The ink tank interconnect device 6 includes a vent hole 9, a vent hole barrier 10 and a top wall 11. In the illustrated non-connected state, the vent hole 9 is open to the inner volume 4 for holding ink and sealed from the outside by the vent hole barrier 10. In the illustrated non-connected state, the vent hole 9 is defined by a locally reduced wall portion or an indentation in the inner surface of the top wall 11. In other not shown examples, the indentation can be provided on the outer surface of the top wall 11. For example, the closes the vent hole barrier 10 in a substantially fluid tight fashion, for example to allow transport of the ink tank 1 in all orientations without ink leakage and with little or no gas exchange.

For example, the ink tank 1 is provided with rigid walls 18, including a rigid top wall 11. For example, the ink tank 1 is bagless, that is, not provided with a flexible bag, contrary to conventional large volume ink tanks (not shown) that are sometimes provided with flexible bags for holding ink or air. These flexible bags can have different functions amongst which backpressure regulation, gas impermeability, transport requirement fulfillment or preventing chemical reaction with the rigid walls. The conventional flexible bags are typically arranged so as to move with respect to the outer box.

In an example ink tank 1 of this disclosure, the ink is directly contained by the rigid walls 18, not by a flexible bag. However, it is not excluded that an example ink tank 1 of this disclosure includes a foil or lining or the like that is placed against the inside of the walls for example to enhance fluid impermeability or prevent chemical reaction with the ink. For example, the material of the rigid walls 18 can be chosen to prevent chemical reaction with Ultra-Violet curable ink. For example, the inner volume 4 of the ink tank 4 holds ultraviolet curable ink. Ultraviolet curable inks well-known in the industry and are ink compounds that are design to be cured by ultraviolet radiation. For example, suitable polymer containing material such as plastic can be chosen. For example the ink tank walls include HDPE (High-Density Polyethylene). For example, the top portion 3 and/or ink tank lid includes PP (Polypropylene). For example, the ink tank 1 has an inner volume 4 large enough to contain at least approximately one, at least approximately three, at least approximately four, or at least approximately five liters of ink of a predefined color. In other examples, the inner volume 4 contains at least approximately ten liters, or at least approximately 15 liters of ink.

For example, the top wall 11 includes the vent hole barrier 10. For example, the vent hole barrier 10 is integrally molded together with the top wall 11, the wall 11 and barrier 10 forming a solid single cast. For example, the vent hole barrier 10 is defined by a locally reduced wall portion wherein the locally reduced wall portion also defines the vent hole 9. For example at least one notch 12, 13 is provided around the vent hole barrier 10. For example the at least one notch is formed by one or more indentations or one or more cut lines. For example the at least one notch 12, 13 is defined by a wall portion that is more reduced than the wall portion that defines the vent hole barrier 10. The notch 12, 13 is arranged to allow the vent hole barrier 10 to be cut loose with respect to the surrounding top wall 11, thereby communicating the vent hole 9 with the environment (FIG. 3). For example, the circumferential dimensions of the vent hole barrier 10 are defined by the at least one notch 12, 13. For example, the at least one notch 12, 13 is arranged in the shape of a circle or ellipse. The at least one notch 12, 13 can be provided in an interrupted or continuous manner.

For example, the vent hole barrier 10 is arranged to be pushed open by the ink inlet device 14 during interconnection. For example, the ink inlet device 14 is connected to a printer to transport the ink out of the ink tank 1 to the printer. FIG. 3 illustrates an example ink inlet device 14 in interrupted lines, arranged to interconnect with the example outlet tube 7. For example, the ink inlet device 14 is moved over the ink outlet 5 for interconnection. For example, during said interconnection the ink inlet device 14 pushes against the vent hole barrier 10. When a sufficient pushing force is applied the vent hole 9 opens, allowing entry (or exit) of air into (or out of) the inner volume 4, for example during dispensing of ink out of the inner volume 4. For example, the vent hole barrier 10 is strong enough to resist unintended opening such as during transport.

For example, in open condition the vent hole 9 maintains an ambient pressure in the inner volume 4. The vent hole 9 can be opened by mere connection of the ink tank 1 with the ink inlet device of a printer, needing no additional tools or handling to create the vent hole 9, and flexible ink holding bags can be prevented. For example, the rigid ink tank walls 18 are stiff and strong enough to withstand certain inner and outer pressures as required by international transport regulations, withstanding substantial changes of the inner volume size (although marginal deformation may occur). After interconnection with the ink inlet device 14 and during printing, the vent hole 9 allows for ambient air or basically any gas to enter the inner volume 4 preventing backpressure from building up in the inner volume 4 and preventing stresses on the walls 18. In certain examples, it can prevent that an ink suctioning device such as a pump operates under too much load due to a high pressure differential between the inside of the ink tank 1 and the exit of the ink suctioning device. In a further example it prevents backpressure from limiting an amount of ink that can be removed from the inner volume 4.

For example, the ink inlet device 14 or the vent hole barrier 10 includes an opening structure 15 to allow the vent hole barrier 10 to be pushed open before the ink inlet device 14 abuts the top wall 11. In the illustrated example, the opening structure is defined by a local extension 15 of the ink inlet device 14 that engages the vent hole barrier 10 and pushes the vent hole barrier 10 towards the inner volume 4 for opening the vent hole 9. In another example that will be discussed below an opening structure 26 is attached to the vent hole barrier 10 and the ink inlet device 14 pushes against that opening structure 26 for opening the vent hole barrier 10.

Figure 4:
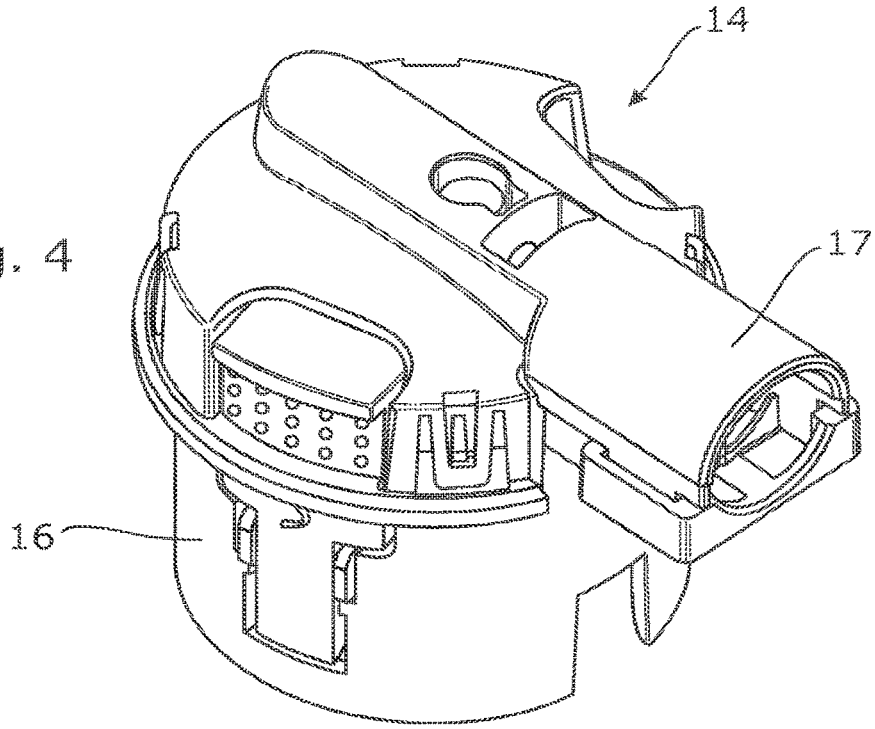
FIG. 4 illustrates a perspective view of an example of an ink inlet device.
Figure 5:
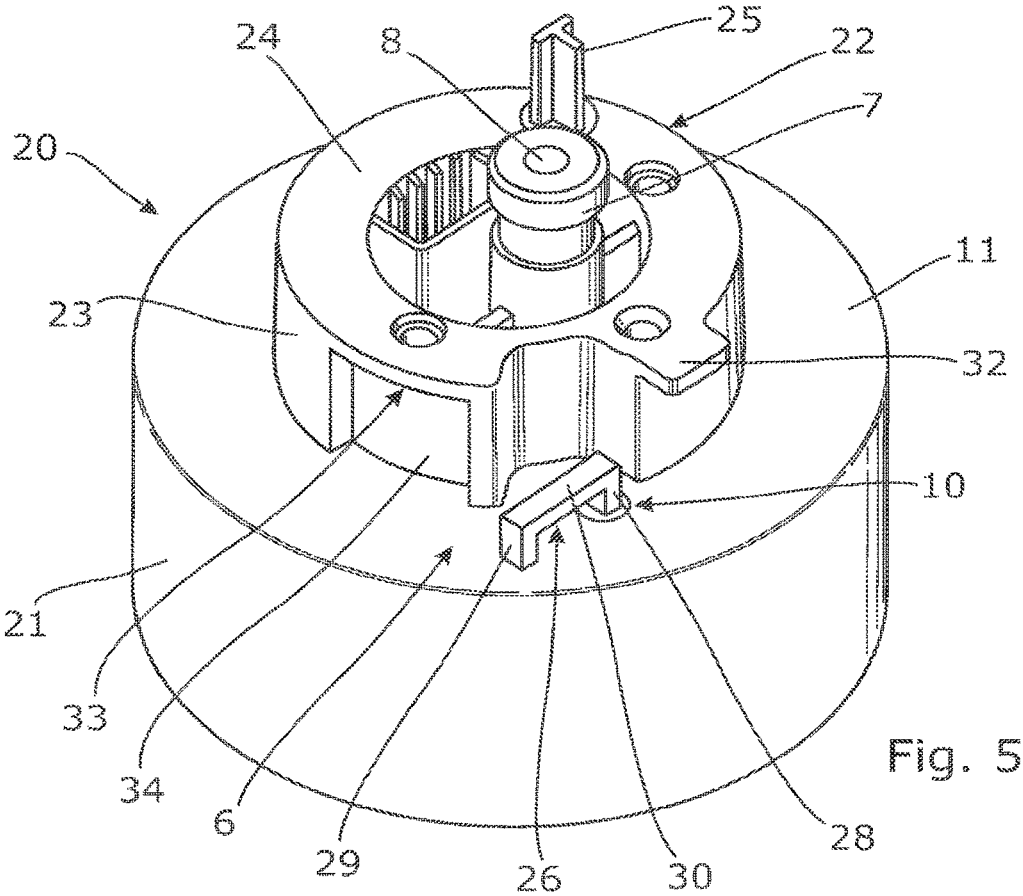
FIG. 5 illustrates a perspective view of an example of an ink tank lid.

FIG. 4 illustrates an example of an ink inlet device 14. For example, the ink inlet device 14 includes an interconnect portion 16 for connecting the ink inlet device 14 to the ink tank interconnect device 6. For example, the inlet interconnect portion 16 has a cylindrical shape for alignment with respect to a corresponding cylindrical interconnect feature 22 of the ink tank interconnect device 6 (FIG. 5). For example the ink inlet device 14 includes an ink channel 17 that fluidically interconnects with the inner outlet channel 8 for receiving the ink from the ink tank 1 and delivering the ink to the printer. In an example, the ink inlet device 14 can be a separate interconnect piece for manual mounting to the printer and/or ink tank interconnect device 6 by an end user. In other examples the ink inlet device 14 is pre-assembled to the printer or pre-assembled to the ink tank interconnect device 6 by a printer or ink tank manufacturer or service provider.

Figure 6:
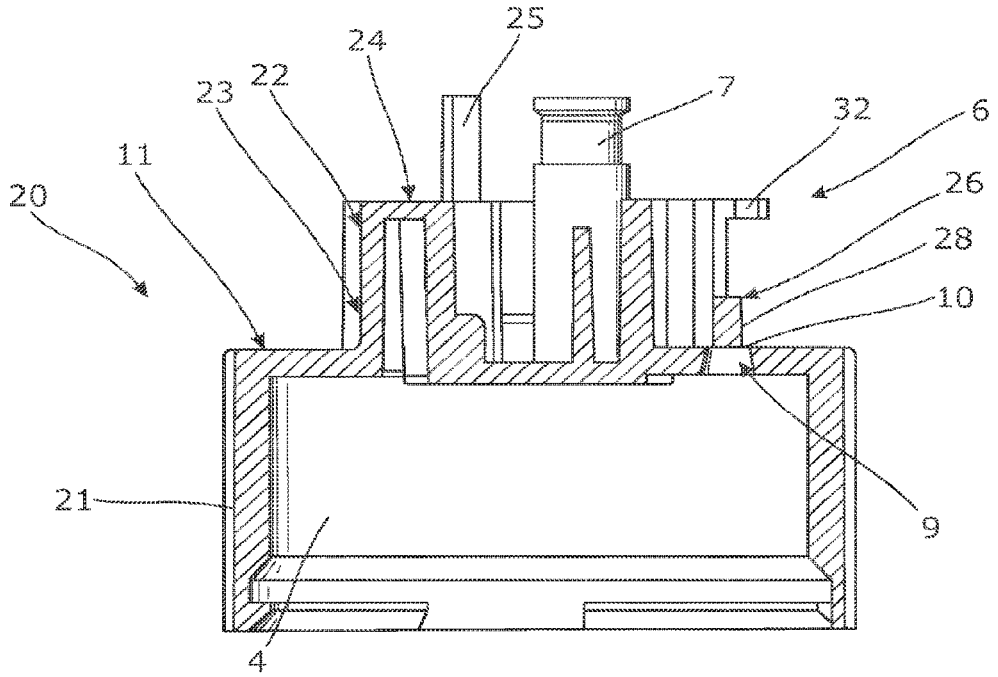
FIG. 6 illustrates a cross sectional side view of the example of the ink tank lid of FIG. 5.
Figure 7:
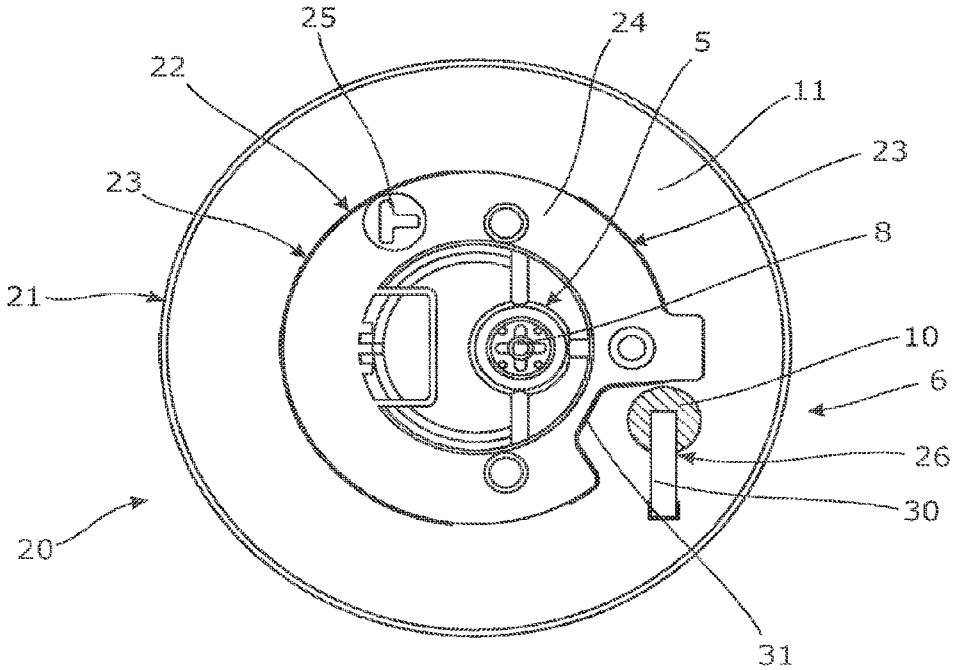
FIG. 7 illustrates a top view of an example of the ink tank lid of FIGS. 5 and 7.

FIGS. 5, 6 and 7 illustrate an example of an ink tank lid 20. In an example, the ink tank lid 20 is mounted to an ink tank body portion 2 in either a permanent or a replaceable manner (FIG. 1). For example, the illustrated ink tank lid 20 is largely defined by a single cast. For example, certain parts such as seal rings, outlet seals or valves can be assembled afterwards. For example, the ink tank lid 20 includes a collar wall 21 and a top wall 11. For example the ink tank interconnect device 6 is provided on the top wall 11. For example, the ink tank interconnect device 6 includes an interconnect feature 22. For example, the interconnect feature 22 is arranged to connect to the corresponding interconnect portion 16 of the ink inlet device 14. For example, the interconnect feature 22 includes a substantially cylindrical side wall 23 and a second top wall 24. The ink tank 1 and ink tank lid 20 are provided with mold release tolerances.

For example, the outlet 5 includes an ink outlet tube 7 and an inner outlet channel 8. For example, the ink outlet tube 7 protrudes from a second top wall 24 for connection to a corresponding inlet feature (not shown). For example, in the shown pre-connection state of the ink tank lid 20 the inner outlet channel 8 is sealed by a valve, sealing foil, thin wall or other suitable feature that needs to be pierced through or opened during interconnection of the ink outlet 5 and ink inlet device 14, or manually removed before interconnection. For example, the vent hole 9 and vent hole barrier 10 are distanced from the ink outlet 5 and need to be opened at a distance from the ink outlet 5.

For example, the ink tank interconnect device 6 includes a color key 25. For example, the color key 25 protrudes from the second top wall 24. For example, for a set of ink tanks 1 of different colors, each ink tank 1 has a differently arranged color key 25. For example, the color key 25 is arranged to prevent that the ink outlet 5 is connected to the wrong ink inlet device 14, preventing color mix-up. Also, the color key 25 can provide for alignment of the ink inlet device 14 during interconnection. For example, the color key 25 includes one or more T-shaped beams having a length direction that is approximately parallel to the length direction of the protruding outlet tube 7. For example, for each color the number of T-beams or the rotational orientation of the T-beams is predefined.

For example, the ink tank interconnect device 6 includes an opening structure 26 and the vent hole barrier 10. As seen from the example top view of FIG. 7, the opening structure 26 and vent hole barrier 10 are arranged next to the ink outlet 5, and next to the interconnect feature 22. For example, the opening structure 26 is connected to the vent hole barrier 10 so that the vent hole barrier 10 can be ruptured by pushing the opening structure 26, for example at notches (not illustrated in FIGS. 5-7 but diagrammatically illustrated in FIG. 2 with reference numbers 12, 13). For example, the opening structure 26 includes a protruding structure that protrudes from the vent hole barrier 10. In the illustrated example, the opening structure is defined by a N- or U-shaped protruding structure, including a bridging structure or middle portion 30 that includes an engagement surface for being engaged by the ink inlet device 14.

For example, the opening structure 26, the top wall 11 and the vent hole barrier 10 are molded by a single mold, that is, the top wall 11, the barrier 10 and the opening structure 26 are defined by a solid single cast of a single material such as plastics. For example, the vent hole 9 is defined by an indentation the inner or outer surface of the top wall 11. For example, a cross sectional wall thickness at the vent hole barrier 10 is thinner than the cross sectional wall thickness of the top wall 11 around the vent hole barrier 10, while the cross sectional thickness at the notches around the vent hole barrier 10 is less than the cross sectional wall thickness of the vent hole barrier 10.

For example, the opening structure 26 is arranged close to the interconnect feature 22 so that the ink inlet device 14 can engage the opening structure 26 during engagement of the interconnect feature 22. For example, the substantially cylindrical side wall 23 includes an indentation 31. For example, the opening structure 26 or the vent hole barrier 10 resides close to the cylindrical wall 23, at least partially in or near the indentation 31 of the cylindrical side wall. For example a part of the opening structure 26 and/or vent hole barrier 10 resides within a circular circumference that defines the cylindrical wall 23.

For example, the opening structure 26 includes a first leg 28 connected to the vent hole barrier 10. For example, the opening structure 26 includes a second leg 29 connected to the top wall 11 next to the vent hole barrier 10. For example, the opening structure 26 includes a middle portion 30 connecting the two legs 28, 29. For example, the middle portion 30 includes the engagement surface for engaging the ink inlet device 14. For example, the opening structure 26 is defined by a U-shaped beam. For example, the legs 28, 29 and middle portion 30 are defined by a solid single cast, and are cast together with the top wall 11 and vent hole barrier 10. For example, the first leg 28 and/or the middle portion 30 facilitate engagement of the ink inlet device 14, for pushing the vent hole barrier 10. For example, the second leg 29 and/or the middle portion 30 are arranged to facilitate bending of the opening structure 26, during opening of the vent hole barrier 10, so that the opening structure 26 can push the vent hole barrier 10 downwards while remaining attached to the top wall 11.

Figure 8:
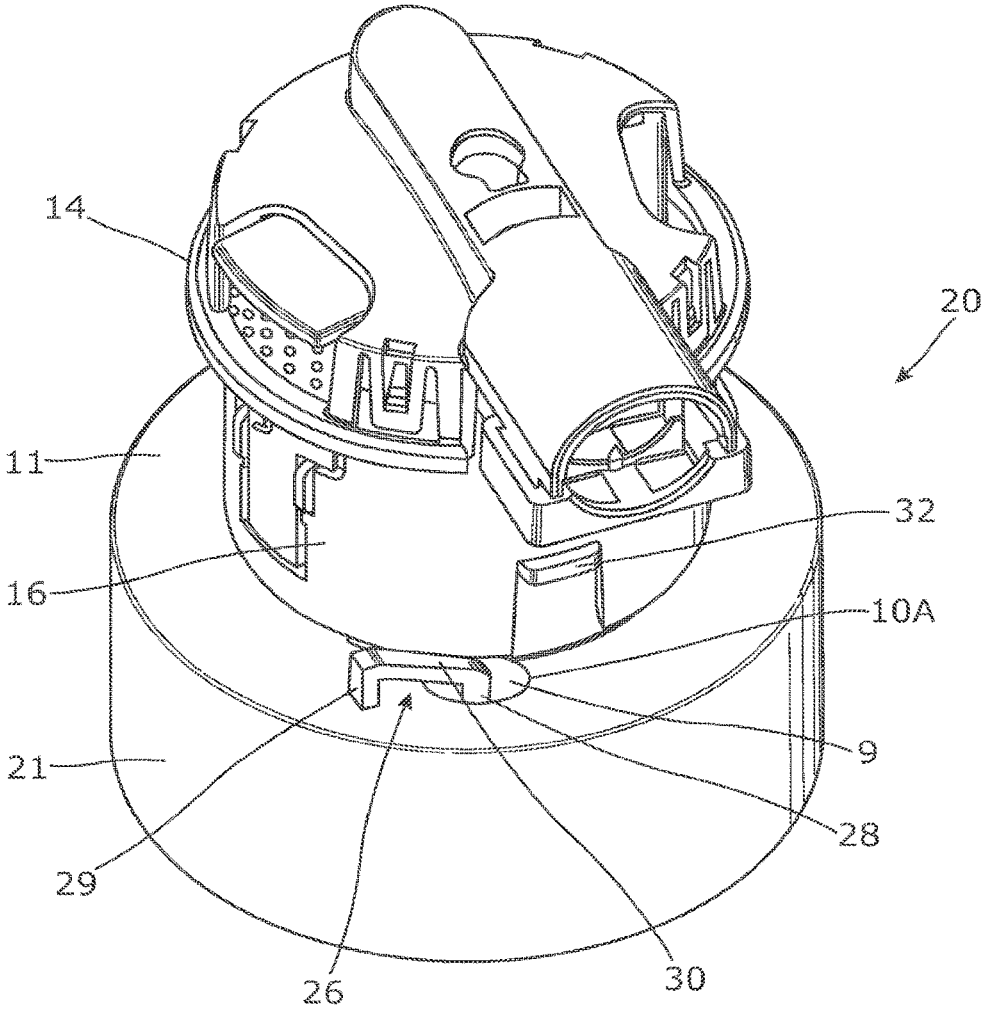
FIG. 8 illustrates a perspective view of the examples of the ink inlet device of FIG. 4 and the ink tank lid of FIGS. 5, 6 and 7 in an interconnected state.

For example, the second leg 29 and the middle portion facilitate a certain resistance towards being moved downwards for opening the vent hole 9, so that when the ink inlet device 14 is disconnected again, the vent hole barrier 10 moves towards the original position again, substantially closing the vent hole 9 again. For example after rupturing the vent hole barrier's edge, the middle portion 30 functions as a cantilever beam wherein the internal material stresses tend to force the cantilever beam back towards the original position. For example, during disconnection the opening structure 26 and vent hole barrier 10 move from the open position, as illustrated in FIG. 5, towards the original position, as illustrated in FIG. 8 but wherein the top wall 11 is ruptured around the vent hole barrier 10. For example, a thickness and material of the opening structure 26 is such that the second leg 29 and middle portion 30 resist to bending.

For example, the interconnect feature 22 has an alignment function for aligning the inlet interconnect portion 16 with respect to the ink outlet 5. For example, the interconnect feature 22 includes an alignment feature 32 that provides for a rotational alignment of the ink inlet interconnect portion 16 with respect to the interconnect feature 22. For example, the alignment feature 32 is defined by a protrusion extending away from the cylindrical side wall 23. For example, the interconnect feature 22 includes a latch surface 33 for engaging a corresponding latch feature of the ink inlet device 14 to retain the ink inlet device 14 with respect to the ink tank interconnect device 6. For example, the latch surface 33 is defined by a second indentation 34 in the cylindrical outer wall 23 of the interconnect feature 22 and the latch surface 33 extends inwards into the cylindrical side wall 23 of the interconnect feature 22.

FIG. 8 illustrates an example of the ink tank lid 20 and the ink inlet device 14 in an interconnected state. In the interconnected state the ink inlet device 14 pushes a part of the opening structure 26 into the top wall 11, rupturing the vent hole barrier 10 along the notches. The example of FIG. 6 shows a circular cut line 10A along which the vent hole barrier 10 is torn open. For example, the vent hole barrier 10 is ruptured over 360 degrees opening, and remains connected to the top wall 11 only through the opening structure 26. In another example, the vent hole barrier 10 is torn along only part of a circle so that a part of the vent hole barrier 10 is still connected to the top wall 11. For example, the ink tank interconnect device 6 is arranged such that in the interconnected state the middle portion 30 of the opening structure 26 is inclined towards the vent hole 9, the first leg 28 extends partially in the vent hole 9, and the vent hole barrier 10 resides in the inner volume 4. For example, the vent hole 9 communicates directly with the ink holding inner volume 4.

Figure 9:
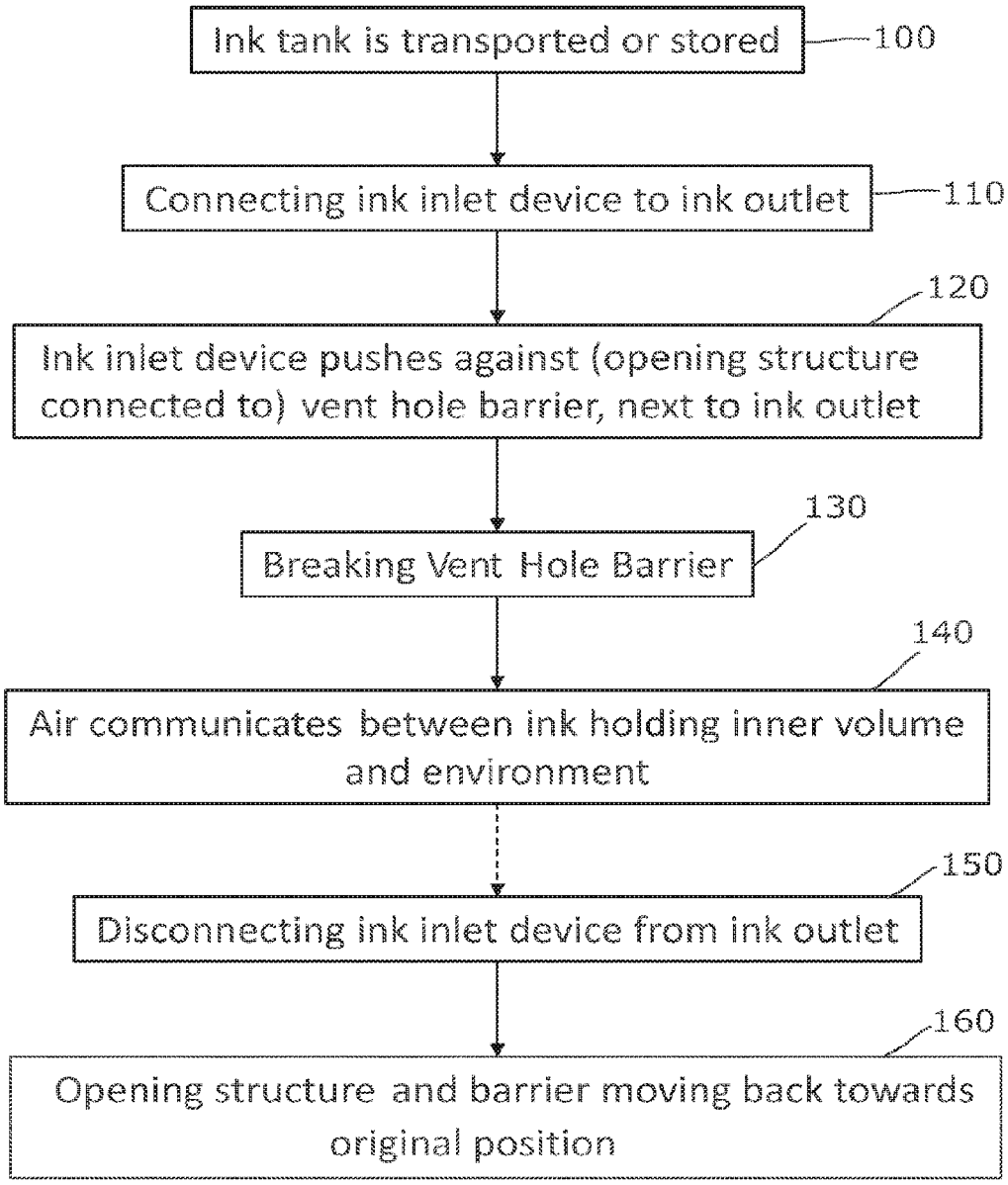
FIG. 9 illustrates a flow chart of an example of a method of creating a vent hole through a solid ink tank wall.

FIG. 9 shows an example of a flow chart of a method of creating a vent hole 9 through an ink tank wall 11. For example, the ink tank 1 is first transported to a location near a compatible printer, and/or stored somewhere near the printer (block 100). Then, the ink tank 1 is brought to the printer, for example placed in or on a predefined location of the printer. For example, the method includes connecting one of the ink inlet devices 14 of the printer to the ink outlet 5 of the ink tank 1 (block 110). For example, during said connection the ink inlet device 14 pushes against the vent hole barrier 10, arranged next to the ink outlet 5 (block 120). In a further example, during said connection the ink inlet device 14 pushes against the opening structure 26 connected to the vent hole barrier 10. For example, the vent hole barrier 10 ruptures by said pushing action (block 130), allowing air to communicate between the ink holding inner volume 4 of the ink tank 1 and the environment (block 140). For example, the vent hole 9 does not communicate with a further tube or channel but directly with the open environment. In a further example, the ink tank 1 and the ink inlet device 14 are disconnected (block 150), for example when the ink tank 1 is substantially depleted or otherwise ceases to provide ink to the ink inlet device 14. For example, the opening structure 26 and vent hole barrier 10 then move back towards the original position again. For example the middle portion 30 and/or second leg 29 bend back so that the vent hole barrier 10 substantially closes the vent hole 9 again.

For example, in a first aspect, an ink tank interconnect device 6 is provided, including an ink outlet 5 arranged to interconnect with a corresponding ink inlet device 14, walls 11, 18, 21, 23, 24, and a vent hole 9 next to the outlet 5 formed in one of the walls 11, 18, 21, 23, 24. In the illustrated example the vent hole 9 is formed in the top wall 11. For example, the vent hole 9 can also be formed in an inclined wall or other wall. The wall 11, 18, 21, 23, 24 includes a vent hole barrier 10 closing the vent hole 9, the vent hole 9 and vent hole barrier 10 being placed with respect to the ink outlet 5 so that the ink inlet device 14 pushes open the vent hole 9 during interconnection. For example, the wall 11 and the vent hole barrier 10 are defined by a single solid cast, that is, molded in the same mold and molding action, wherein molding may include injection molding, compression molding, rotation molding, blow molding, etc. For example, the top wall 11 includes at least one notch 12, 13 around the vent hole barrier 10 for tearing open the vent hole barrier 10 along the notch 12, 13 by said pushing action, therewith opening the vent hole 9 allowing air to pass through the vent hole 9. For example, the ink tank interconnect device 6 includes an opening structure 26 connected to the vent hole barrier 10, for engagement by the ink inlet device 14, the opening structure 26 and vent hole barrier 10 being defined by a single solid cast. For example, the opening structure 26 includes a first leg 26 connected to the vent hole barrier 10, a second leg 29 connected to the wall 11 next to the vent hole barrier 10, and a middle portion 30 connecting the two legs 28, 29. For example, the middle portion 30 is arranged to bend during opening of the vent hole barrier 10 and to move back towards the original position when the ink inlet device 14 is disconnected. For example, the opening structure 26 moves back from the position of FIG. 8 to the position of FIG. 5 but wherein the notches 12, 13 remain ruptured. For example, an interconnect feature 22 protrudes from the wall 11, wherein the interconnect feature has a substantially cylindrical side wall 23 that has a substantially circular circumference, wherein at least a part of the vent hole barrier 10 extends within the circular circumference, in an indentation 31 of the cylindrical side wall 23. For example, the ink tank interconnect device 6 includes an outwards protruding color-specific color key 25. In a further example, the ink tank interconnect device 6 includes an interconnect feature 22 protruding from a top wall 11, the interconnect feature including a cylindrical side wall 23 and a second top wall 24, the ink tank interconnect device 6 further including an opening structure 26 connected to the vent hole barrier 10, the opening structure 26 arranged next to the interconnect feature 22, for engagement by the ink inlet device 14. For example, the ink tank interconnect device 22 further includes a color key 25 extending away from the second top wall 24 of the interconnect feature 22, and an ink outlet 5 extending away from the second top wall 24 of the interconnect feature 22, a length direction of the ink outlet 5 and the color key 25 being parallel to facilitate the fluidic interconnection of the ink inlet device 14 and the ink outlet 5. For example, an ink tank lid 20 is provided for connection to the ink tank body portion 2 including the ink tank interconnect device 6. For example, an ink tank 1 is provided that includes the ink tank interconnecting device 6. For example, the ink tank 1 is a bagless ink tank 1, includes rigid plastic walls 11, 18, 21, 23, 24, the rigid plastic walls 11, 18, 21, 23, 24 enclosing an inner volume 4 of at least approximately one liter. For example, the ink tank 1 is at least partially filled with ultra-violet curable ink.

For example, in a second aspect, an ink tank 1 is provided, including an inner volume 4 for holding ink, defined by rigid ink tank walls 11, 18, 21, 23, 24. For example the ink tank 1 includes an ink outlet 5 connected to a second top wall 24 of the ink tank 1, arranged to be interconnected with an ink inlet device 14. For example the ink tank 1 includes a vent hole 9 near the ink outlet 5 that is open to the inner volume 4 and sealed from the outside by a vent hole barrier 10, the barrier 10 being arranged to be pushed open when the ink inlet device 14 is connected to the ink outlet 5, to allow entry of ambient air into the inner volume 4, for example so that free ambient air enters directly into the vent hole 10 without passing through a tube or channel. For example, the ink tank 1 further includes an interconnect feature 22 for aligning the ink inlet device 14 with the ink outlet 5, and an opening structure 26 connected to the vent hole barrier 10 that is placed next to the interconnected feature 22, so as to be engaged by the ink inlet device 14 during interconnection so that the ink inlet device 14 pushes against the opening structure 26 therewith opening the vent hole barrier 10, for example by rupturing.

For example, in a third aspect a method of creating a vent hole 9 through an ink tank wall 11 is provided. For example, the method includes (i) connecting an ink inlet device 14 of a printer to an ink outlet 5 of the ink tank 1, (ii) pushing the ink inlet device 14 against a vent hole barrier 10 next to the ink outlet 5 during the connection, and (iii) by said pushing action rupturing the vent hole barrier 10, allowing air to communicate between an ink holding inner volume 4 of the ink tank 1 and the environment. For example, the connecting of the ink inlet device 14 to the ink outlet 5 includes pushing the ink inlet device 14 against an opening structure 26 connected to the vent hole barrier 10. For example, after using at least some of the ink in the ink tank 1 the ink inlet device 14 is disconnected from the ink outlet 5, and the opening structure 26 and vent hole barrier 10 move back towards the original position. For example, the middle portion 30 bends back so that vent hole barrier 10 closes the vent hole 9, at least in such a manner that it is more difficult for air or ink to pass through the vent hole 9.

For example, the indentation that forms the vent hole 9 is provided on the inner surface of the top wall 11 to allow the opening structure 26 to facilitate molding of the opening structure 26. In this example, the vent hole barrier 10 can be relatively flush with the outer surface (FIGS. 3, 5). In other examples, the opening structure 26 can have other shapes, for example non-U-shaped. For example, depending on the shape of the opening structure 26 the indentation can be provided on the outer surface of the top wall 11, and for example the vent hole barrier 10 can be flush with the inner surface. In a further example, a U-shaped opening structure 26 with said two legs 28, 29 and middle portion 30 can have the advantage of providing a relatively large and robust engagement feature for the inlet device 14, in addition to the resilience that facilitates moving the barrier 10 towards closing position after disconnection of the inlet device 14.

An example ink tank interconnect device including an ink outlet to interconnect with a corresponding ink inlet device, walls, and a vent hole next to the ink outlet formed in one of the walls, the wall including a vent hole barrier closing the vent hole, the vent hole and vent hole barrier being placed with respect to the ink outlet so that the ink inlet device pushes open the vent hole during interconnection.

In some examples, the wall and the vent hole barrier are defined by a single solid cast. In some examples, the wall comprising at least one notch around the vent hole barrier for tearing the vent hole barrier open over the notch by said pushing, wherein the vent hole barrier has a thinner cross section than the surrounding wall and the wall at the notch has a thinner cross section than the vent hole barrier. In some examples, an opening structure connected to the vent hole barrier, for engagement by the ink inlet device, the opening structure and vent hole barrier being defined by a single solid cast. In some examples, the opening structure comprising a first leg connected to the vent hole barrier, a second leg connected to the wall next to the vent hole barrier, and a middle portion connecting the two legs. In some examples, the middle portion is arranged to bend during opening of the vent hole barrier, against a resilient force of the middle portion or second leg, and to move back towards the original position when the ink inlet device is disconnected by the resilient force of the middle portion or second leg.

In some examples, an interconnect feature protruding from the wall, wherein the interconnect feature has a substantially cylindrical side wall that has a substantially circular circumference, wherein at least a part of the vent hole barrier resides within the circular circumference, in an indentation of the cylindrical side wall. In some examples, an interconnect feature protruding from a top wall and comprising a cylindrical side wall and a second top wall, an opening structure connected to the vent hole barrier, arranged next to the interconnect feature, for engagement by the ink inlet device, a color key extending away from the second top wall, and an ink outlet extending away from the second top wall, the length directions of the color key and ink outlet being parallel to facilitate said interconnection.

In some examples, an ink tank lid for connection to an ink tank body portion including ink tank interconnect device as disclosed herein.

In some examples, an ink tank includes the ink tank interconnect device of as disclosed herein being a bagless ink tank, including rigid plastic walls, the rigid plastic walls enclosing an inner volume of at least approximately one liters. In some examples, the example ink tank is at least partially filled with ultra-violet curable ink.

An example ink tank includes an inner volume for holding ink defined by rigid ink tank walls, an ink outlet connected to a top wall of the ink tank, to be interconnected with an ink inlet device, a vent hole near the ink outlet, the vent hole open to the inner volume, and a vent hole barrier that seals the vent hole from the outside, to be pushed open when the ink inlet device is connected to the ink outlet, to allow entry of ambient air into the inner volume. In some examples, the ink tank as disclosed herein includes an interconnect feature for aligning the ink inlet device with the ink outlet, and an opening structure connected to the vent hole barrier that is placed next to the interconnected feature, so as to be engaged by the ink inlet device during interconnection so that the ink inlet device pushes against the opening structure therewith opening the vent hole barrier.

An example ink outlet is arranged to interconnect with a corresponding ink inlet device. A vent hole is formed next to the ink outlet. A vent hole barrier is arranged to be pushed open by the ink inlet device during interconnection.

An example method of creating a vent hole through a solid ink tank wall includes connecting an ink inlet device of a printer to an ink outlet of the ink tank, pushing the ink inlet device against a vent hole barrier next to the ink outlet during the connection, and by said pushing action rupturing the vent hole barrier, allowing air to communicate between an ink holding inner volume of the ink tank and the environment. In some examples, the method includes pushing the ink inlet device against an opening structure connected to the vent hole barrier, disconnecting the ink inlet device from the ink outlet, and the opening structure and vent hole barrier moving back towards the original position.

An ink tank interconnect device including an ink outlet to interconnect with a corresponding ink inlet device, walls, a vent hole next to the ink outlet formed in one of the walls, the wall including a vent hole barrier closing the vent hole, the vent hole and vent hole barrier being placed with respect to the ink outlet so that the ink inlet device pushes open the vent hole during interconnection, an interconnect feature protruding from a top wall and comprising a cylindrical side wall and a second top wall, and an opening structure connected to the vent hole barrier, arranged next to the interconnect feature, for engagement by the ink inlet device.

In some examples, the wall and the vent hole barrier are defined by a single solid cast. In some examples, the wall includes at least one notch around the vent hole barrier for tearing the vent hole barrier open over the notch by said pushing, wherein the vent hole barrier has a thinner cross section than the surrounding wall and the wall at the notch has a thinner cross section than the vent hole barrier. In some examples, the ink tank interconnect device includes an opening structure connected to the vent hole barrier, for engagement by the ink inlet device, the opening structure and vent hole barrier being defined by a single solid cast. In some examples, the opening structure includes a first leg connected to the vent hole barrier, a second leg connected to the wall next to the vent hole barrier, and a middle portion connecting the two legs.

In some examples, the middle portion is arranged to bend during opening of the vent hole barrier, against a resilient force of the middle portion or second leg, and to move back towards the original position when the ink inlet device is disconnected by the resilient force of the middle portion or second leg. In some examples, the ink tank interconnect device includes an interconnect feature protruding from the wall, wherein the interconnect feature has a substantially cylindrical side wall that has a substantially circular circumference, wherein at least a part of the vent hole barrier resides within the circular circumference, in an indentation of the cylindrical side wall.

In some examples, the ink tank interconnect device includes a color key extending away from the second top wall, and an ink outlet extending away from the second top wall, the length directions of the color key and ink outlet being parallel to facilitate said interconnection. In some examples, an ink tank lid for connection to an ink tank body portion includes the ink tank interconnect device as disclosed herein. An example ink tank includes the ink tank interconnect device as disclosed herein being a bagless ink tank, including rigid plastic walls, the rigid plastic walls enclosing an inner volume of at least approximately one liters. In some examples, the ink tank as disclosed herein is at least partially filled with ultra-violet curable ink. An example ink tank comprising an inner volume for holding ink defined by rigid ink tank walls, an ink outlet connected to a top wall of the ink tank, to be interconnected with an ink inlet device, a vent hole near the ink outlet, the vent hole open to the inner volume, a vent hole barrier that seals the vent hole from the outside, to be pushed open when the ink inlet device is connected to the ink outlet, to allow entry of ambient air into the inner volume, an interconnect feature for aligning the ink inlet device with the ink outlet, and an opening structure connected to the vent hole barrier that is placed next to the interconnected feature, so as to be engaged by the ink inlet device during interconnection so that the ink inlet device pushes against the opening structure therewith opening the vent hole barrier.

An example method of creating a vent hole through a solid ink tank wall, includes connecting an ink inlet device of a printer to an ink outlet of the ink tank, pushing the ink inlet device against a vent hole barrier next to the ink outlet during the connection, by said pushing action rupturing the vent hole barrier, allowing air to communicate between an ink holding inner volume of the ink tank and the environment, pushing the ink inlet device against an opening structure connected to the vent hole barrier, disconnecting the ink inlet device from the ink outlet, and the opening structure and vent hole barrier moving back towards the original position.

The above description is not intended to be exhaustive or to limit this disclosure to the examples disclosed. Other variations to the disclosed examples can be understood and effected by those of ordinary skill in the art from a study of the drawings, the disclosure, and the claims. The indefinite article "a" or "an" does not exclude a plurality, while a reference to a certain number of elements does not exclude the possibility of having more or less elements. A single unit may fulfil the functions of several items recited in the disclosure, and vice versa several items may fulfil the function of one unit. Multiple alternatives, equivalents, variations and combinations may be made without departing from the scope of this disclosure.

The invention claimed is:

1. An apparatus, comprising:

a container defining an internal volume including an aperture to provide access to the internal volume;

a vent associated with the aperture, the vent in a closed position prior to coupling the apparatus to a printer, the vent entering an open position in response to an interaction with a connector of the printer; and a cap having an opener to interface with the connector and to cause the vent to enter the open position.

2. The apparatus of claim 1, further including a cover to secure the vent in the closed position prior to the coupling of the apparatus to the printer.

3. The apparatus of claim 2, wherein the cover is integral to the container.

4. The apparatus of claim 2, wherein the cover includes at least one of an area of weakness and a line of weakness to enable the vent to enter the open position in response to the interaction with the connector of the printer.

5. The apparatus of claim 1, wherein in the open position, the vent is in fluid communication with the atmosphere.

6. The apparatus of claim 1, further including a cap having a first portion covering the vent in the closed position, and a second portion adjacent the first portion, the first portion having a first thickness, the second portion having a second thickness, the first thickness being less than the second thickness to enable the vent to enter the open position in response to the interaction with the connector of the printer.

7. The apparatus of claim 1, wherein walls of the container defining the internal volume include a material to deter a chemical reaction from occurring with ink.

8. The apparatus of claim 1, wherein walls of the container defining the internal volume include material to deter permeability of the walls by ink.

9. The apparatus of claim 1, further including a cap having a notch and a protrusion, the notch to receive a latch of the connector to couple the connector to the cap, the protrusion to be received within a guide of the connector to enable alignment of the connector relative to the cap.

10. The apparatus of claim 9, wherein the cap includes an extension and a collar, the extension including the notch and the protrusion, the collar including the vent.

11. The apparatus of claim 10, wherein the extension defines a groove to enable access to the vent.

12. The apparatus of claim 1, wherein the opener includes at least one of an N-shaped protrusion and a U-shaped protrusion, the opener located between the vent and a portion of the cap adjacent the vent.

13. The apparatus of claim 1, wherein the opener includes a first portion and a second portion, the first portion coupled to a third portion of the cap adjacent the vent, the second portion coupled to the vent, the second portion to drive the vent toward the open position in response to the opener interacting with the connector.

14. The apparatus of claim 13, wherein the opener includes a third portion coupled between the first portion and the second portion.

15. The apparatus of claim 13, wherein the first portion of the opener is to remain coupled to the third portion of the cap to cause the vent to enter the closed position in response to the connector being decoupled from the cap.

16. The apparatus of claim 1, further including an actuator to interact with the connector to cause the vent to enter the open position, the actuator to cause the vent to enter the closed position in response to the connector being decoupled from the container.

17. A method, comprising:

coupling a connector of a printer to a container including a vent; and actuating the vent to an open position in response to an interaction with the connector, the vent having a closed position prior to the coupling of the connector to the container;

wherein the actuating further includes interfacing a cap of the container having an opener with the connector; and causing the opener to open the vent to enter the open position.

18. An apparatus, comprising:

a container defining an internal volume including an aperture to provide access to the internal volume; and a cap to be coupled to the container, the cap including a vent actuatable between an open position and a closed position, the vent having the closed position prior to coupling the apparatus to a printer, the vent entering the open position in response to the cap being coupled to a connector of the printer, the vent re-entering the closed position in response to the cap being decoupled from the connector.

19. The apparatus of claim 18, wherein the cap includes an actuator including a first portion and a second portion, the first portion coupled to a third portion of the cap adjacent the vent, the second portion coupled to the vent, the second portion to drive the vent toward the open position in response to the actuator interacting with the connector.

* * * * *